US007525427B2

(12) United States Patent
Mauriello

(10) Patent No.: US 7,525,427 B2
(45) Date of Patent: Apr. 28, 2009

(54) AUTOMOTIVE HORN AUDIT SYSTEM

(76) Inventor: Joseph Mauriello, P.O. Box 116, New York, NY (US) 10014

( * ) Notice: Subject to any disclaimer, the term of this patent is extended or adjusted under 35 U.S.C. 154(b) by 217 days.

(21) Appl. No.: 11/247,895

(22) Filed: Oct. 11, 2005

(65) Prior Publication Data

US 2007/0080525 A1 Apr. 12, 2007

(51) Int. Cl.
*G08B 1/08* (2006.01)

(52) U.S. Cl. ..... 340/539.24; 340/438; 340/439

(58) Field of Classification Search ..... 340/539.24, 340/438, 439, 463, 466, 539.31
See application file for complete search history.

(56) References Cited

U.S. PATENT DOCUMENTS 6,631,322 B1 * 10/2003 Arthur et al. ..... 701/211
2002/0013660 A1 * 1/2002 Flick ..... 701/213

* cited by examiner

*Primary Examiner*—Benjamin C Lee
*Assistant Examiner*—Travis R Hunnings
(74) *Attorney, Agent, or Firm*—John Berryhill

(57) ABSTRACT

An automotive audit system maintains a record of usage of a vehicle horn and the record is made accessible for later audit of horn use. The record is maintained in a memory device which may be accessed and read by a law enforcement authority, fleet manager, or other authorized person(s) for the purpose of auditing vehicle horn use. The device comprises a detector for detecting instances of horn use, a counter for counting instances of horn use, and a memory connected with the counter for retaining a record.

13 Claims, 1 Drawing Sheet

AUTOMOTIVE HORN AUDIT SYSTEM

FIELD OF THE INVENTION

The present invention relates to a system and method for auditing and reporting the use of an automotive horn.

BACKGROUND

Automotive horns are a significant source of urban noise pollution. While automotive horns, including truck horns, can be useful signal devices in an emergency situation, many drivers use the horn habitually to express minor annoyance and anger, for social purposes, and to intimidate other drivers. In response to the noise pollution attributable to automotive horns, some states and municipalities have passed legislation penalizing unnecessary horn use. Enforcement of such legislation is impractical since a police officer is required to identify the vehicle from which the sound originated, determine whether use of the horn was necessary, and then stop the vehicle to issue a citation. In New York City, for example, there are posted notices stating a $350 fine for horn honking, yet one may readily observe that such signs have no discernible effect on driver behavior.

SUMMARY OF THE INVENTION

In accordance with the present invention, there is provided a device for counting and registering horn use in a vehicle. The device maintains a record of usage of the vehicle horn, and the record is made accessible for later audit of horn use. In a preferred embodiment, the record is maintained in a memory device which may be accessed and read by a law enforcement authority, fleet manager, or other authorized persons for the purpose of auditing vehicle horn use.

BRIEF DESCRIPTION OF THE DRAWING

The foregoing Summary, as well as the following Detailed Description will best be understood in connection with the attached Drawing in which.

DETAILED DESCRIPTION

Figure 1:
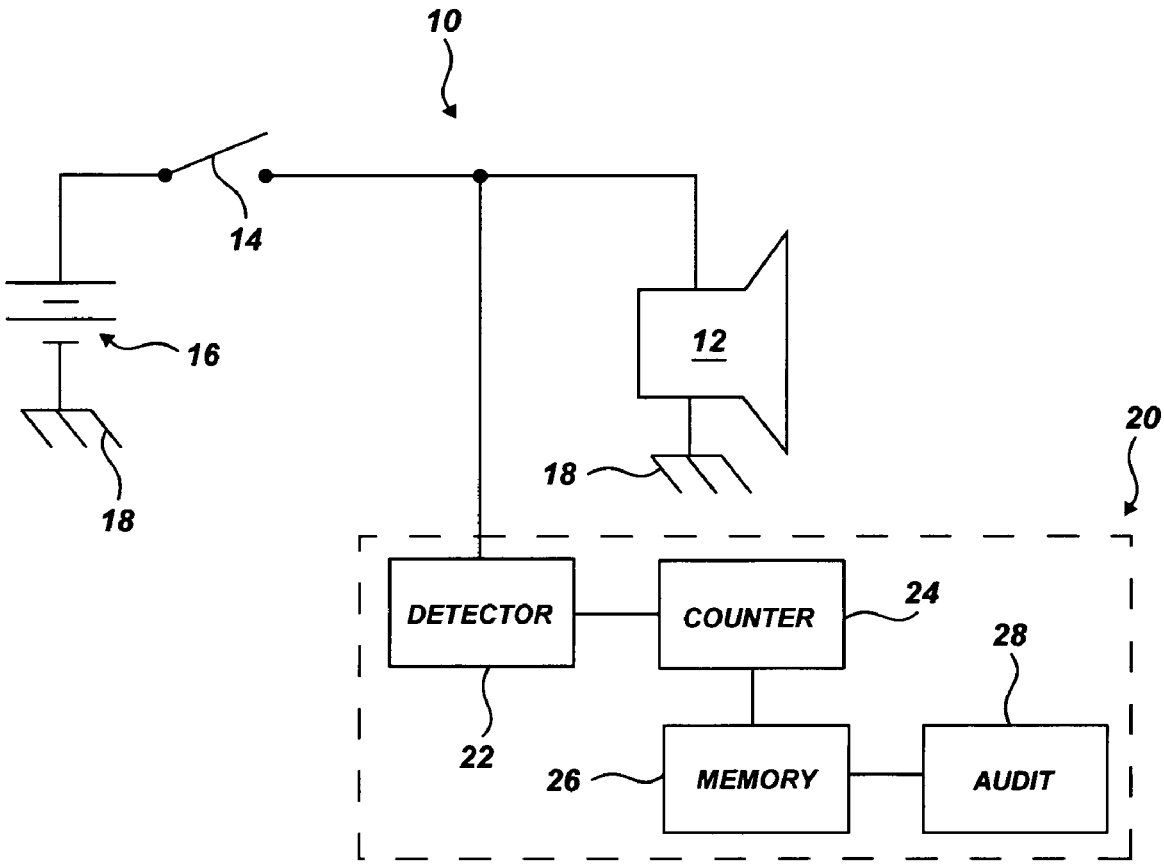
FIG. 1 is a block functional diagram of a vehicle horn circuit with an attached counting and auditing system of the present invetion.

Referring now to FIG. 1, there is shown a vehicle horn circuit 10 in which a vehicle horn 12 is connected to a vehicle chassis ground 18, and to a horn switch 14. The horn switch 14 is of a known type that is typically mounted within the steering mechanism of a vehicle to intermittently connect the vehicle battery 16 with the horn 12. Connected with the vehicle horn circuit 10 is a counting and auditing system 20 for detecting, counting, and recording use of the horn 12, and for providing a mechanism to audit use of the horn 12.

The system 20 includes a detector 22 for detecting use of the horn. Such a detector may comprise a logic input stage of a known type for detecting the presence of a positive voltage applied to the connection between the switch 14 and the horn 12. In other embodiments, the detector 22 may comprise a series resistor along the connection between the switch 14 and horn 12; an inductive pickup located along the connection or on the horn; a separate throw input of switch 14; an audio detector mounted in proximity to the horn 12; or the like. The detector 22 acts to provide a logical input to a counter 24.

The counter 24 receives an input from the the detector 22, and each time the horn is used, the counter 24 advances a count of the number of times the horn 12 has been used. The counter 24 may comprise a binary counting circuit of a known type. In alternative embodiments, the counter 24 may be implemented in software as part of the On-Board Diagnostic (OBD) system of the vehicle, such as the known OBD systems which monitor various automotive functions such as emission control and other vehicle performance measurements. The counter 24 may further be connected with a digital clock and calendar, for recording the time and date of each horn use. The counter 24 may further be connected with the vehicle speedometer and/or navigation system, to record additional data such as the vehicle speed when the horn was used, and the location of the vehicle at each horn use. Whether implemented as a stand-alone system or integrated into the vehicle OBD system, the counter 24 comprises or is connected with a memory 26 for maintaining an accumulated count of the number of times the horn 12 has been used. Such a memory is preferably a non-volatile memory, such as a flash memory of a known type.

The detector 22, the counter 24, and the memory 26, or portions thereof, are preferably positioned in a tamperproof housing in order to prevent an operator of the vehicle or other unauthorized individuals from re-setting or otherwise altering the count of vehicle horn use maintained by the system 20. The system 20 may further comprise an independent power source (not shown), such as a battery for maintaining power to the system if it is disconnected from the vehicle electrical system. The system further includes an audit interface device 28, by which the count maintained by the system is retrieved and made available to a user in human readable form. The audit interface device 28 may include an electrical connector by which a sutably configured audit device may read the count and/or other data stored in the memory 26 and provide a display or printed record of the data (number of uses, dates, times, vehicle mileage, speed, locations) and/or calculate a frequency of horn use. In other embodiments, the audit interface 28 may include a readable digital display mounted in the vehicle, such as on the dashboard. In still other embodiments, the audit interface 28 may include the standard OBD connector and readout system. The audit interface 28 may also be configured to re-set or clear the count or other data stored in the memory 26.

The system of the present invention may find immediate application among operators of fleets of vehicles. For example, a taxi, limousine, bus, utility, courier or trucking company may employ the system to identify drivers of its vehicles who use the horn excessively, where "excessive" may be defined as exceeding a predetermined rate of horn use versus distance or time (e.g. uses/mile, uses/hour, etc.). Rental fleet operators may also audit horn use upon "check in" of rented vehicles, in order to assess charges for potential citations that may have issued during the rental term of the vehicle. Furthermore, the audit interface 28 may be accessed by a law enforcement authority, such as the local motor vehicle licensing authority, in order to audit horn use during regular inspection of the vehicle, and to assess a charge or fine based upon the number of horn uses during a predetermined time period, distance driven, or in excess of a predetermined allowance of horn uses.

I claim:

1. A vehicle horn use control system, comprising:

(a) a detector connected with a vehicle horn, for detecting instances of horn use;

(b) a counter responsively connected with the detector for counting instances of horn use detected by the detector; and (c) a memory connected with the counter for retaining a record of the count of horn use; and (d) an audit interface mounted in the vehicle for providing a human readable representation of the record maintained in the memory, where the vehicle is located.

2. The control system of claim 1, wherein the audit interface comprises a digital display mounted in the vehicle.

3. The control system of claim 2, wherein the counter is connected with a timer for recording the time of each horn use.

4. The control system of claim 2, wherein the counter and memory are mounted in a tamperproof housing.

5. The control system of claim 4 wherein the counter and memory are provided with an independent power supply.

6. The control system of claim 1 wherein the audit interface includes an electrical connector for readably connecting the memory with an audit device to provide a human readable display of an audit of horn uses.

7. A vehicle horn use control system, comprising:

(a) a detector connected with a vehicle horn, for detecting instances of horn use;

(b) a counter responsively connected with the detector for counting instances of horn use detected by the detector;

(c) a memory connected with the counter for retaining a record of the count of horn use;

(d) an audit interface for providing a human readable representation of the record maintained in the memory; and wherein the counter and the memory are integrated with a vehicle on-board diagnostic system, and wherein the audit interface comprises an on-board diagnostic readout device.

8. A vehicle horn use control system, comprising:

(a) a detector connected with a vehicle horn, for detecting instances of horn use;

(b) a counter responsively connected with the detector for counting instances of horn use detected by the detector;

(c) a memory connected with the counter for retaining a record of the count of horn use;

(d) an audit interface for providing a human readable representation of the record maintained in the memory; and wherein the counter is connected with the vehicle speedometer, for collecting and storing the vehicle speed in connection with each horn use.

9. A vehicle horn use control system, comprising:

(a) a detector connected with a vehicle horn, for detecting instances of horn use;

(b) a counter responsively connected with the detector for counting instances of horn use detected by the detector;

(c) a memory connected with the counter for retaining a record of the count of horn use;

(d) an audit interface for providing a human readable representation of the record maintained in the memory; and wherein the counter is connected with the vehicle speedometer, for recording the vehicle mileage in connection with each horn use.

10. A method of controlling vehicle horn use, comprising:

(a) detecting horn use in a vehicle;

(b) maintaining a record of horn use in a memory mounted in the vehicle;

(c) reading the memory to retrieve a count of horn uses; and (d) assessing a penalty based upon the retrieved count of horn uses.

11. The method of claim 10, wherein the penalty is based upon a predetermined value of horn uses defined as excessive.

12. The method of claim 11 wherein the step of maintaining a record of horn use comprises a step of maintaining a record of at least one of vehicle mileage, or time, concurrent with each horn use, and wherein the step of assessing a penalty comprises a step of establishing a predetermined threshold of horn uses per unit distance or horn uses per unit time as said predetermined value of horn uses defined as excessive.

13. The method of claim 10 wherein the step of maintaining a record of horn use comprises a step of maintaining a record of at least one of vehicle mileage, location or time, concurrent with each horn use.

* * * * *